US011619110B2

(12) United States Patent
Pillai et al.

(10) Patent No.: US 11,619,110 B2
(45) Date of Patent: Apr. 4, 2023

(54) SYSTEM AND METHOD FOR AN INTELLIGENT QUICK CONNECT DISCONNECT CONNECTOR (QCDC)

(71) Applicant: FMC Technologies, Inc., Houston, TX (US)

(72) Inventors: Rajeev Pillai, Houston, TX (US); Richard Bridwell, Houston, TX (US); Thiago Machado, Houston, TX (US); Hosameldin Abouelhassan, Houston, TX (US); Kirul Patel, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 125 days.

(21) Appl. No.: 17/006,392

(22) Filed: Aug. 28, 2020

(65) Prior Publication Data

US 2021/0062617 A1 Mar. 4, 2021

Related U.S. Application Data

(60) Provisional application No. 62/892,889, filed on Aug. 28, 2019.

(51) Int. Cl.

| | |
|---|---|
| ***E21B 34/16*** | (2006.01) |
| ***E21B 33/03*** | (2006.01) |
| ***E21B 34/02*** | (2006.01) |
| ***E21B 47/117*** | (2012.01) |
| *E21B 43/26* | (2006.01) |

(52) U.S. Cl.
CPC ..... *E21B 34/16* (2013.01); *E21B 33/03* (2013.01); *E21B 34/02* (2013.01); *E21B 47/117* (2020.05); *E21B 43/2607* (2020.05)

(58) Field of Classification Search
CPC ..... E21B 34/02; E21B 34/025; E21B 34/16; E21B 43/2607; E21B 43/26
See application file for complete search history.

(56) References Cited

U.S. PATENT DOCUMENTS

| | | | | |
|---|---|---|---|---|
| 6,609,734 | B1 | 8/2003 | Baugh | |
| 9,644,443 | B1 | 5/2017 | Johansen et al. | |
| 9,670,745 | B1 | 6/2017 | Johansen et al. | |
| 9,879,496 | B2 | 1/2018 | Johansen et al. | |
| 10,030,461 | B2 | 7/2018 | Johansen et al. | |
| 10,072,474 | B2 | 9/2018 | Johansen et al. | |
| 10,309,180 | B2 | 6/2019 | Johansen et al. | |
| 2013/0199801 | A1* | 8/2013 | Johnson | E21B 33/038 166/387 |
| 2015/0345272 | A1* | 12/2015 | Kajaria | E21B 47/00 166/308.1 |

(Continued)

*Primary Examiner* — Kristyn A Hall
(74) *Attorney, Agent, or Firm* — Osha Bergman Watanabe & Burton LLP

(57) ABSTRACT

A system may include a connector coupled to a wellhead assembly. The system may also include a hydraulic power unit coupled to the connector and a valve of the wellhead assembly. The system may further include a controller in communication with the connector and the hydraulic power unit. The controller may be operable to receive one or more conditions associated with the connector and a valve of the wellhead assembly. The controller may also be operable to operate at least one of the connector and the valve through the hydraulic power unit based on the one or more condition.

20 Claims, 12 Drawing Sheets

(56) References Cited

U.S. PATENT DOCUMENTS

| | | | | |
|---|---|---|---|---|
| 2019/0032439 | A1* | 1/2019 | Smith | E21B 33/038 |
| 2019/0145213 | A1 | 5/2019 | Kibler et al. | |
| 2019/0186226 | A1* | 6/2019 | Beason | E21B 33/068 |

* cited by examiner

SYSTEM AND METHOD FOR AN INTELLIGENT QUICK CONNECT DISCONNECT CONNECTOR (QCDC)

BACKGROUND OF THE INVENTION

Hydraulic fracturing is a stimulation treatment routinely performed on oil and gas wells in low-permeability reservoirs. Specially engineered fluids are pumped at high pressure and rate into the reservoir interval to be treated, causing a vertical fracture to open. The wings of the fracture extend away from the wellbore in opposing directions according to the natural stresses within the formation. Proppant, such as grains of sand of a particular size, is mixed with the treatment fluid to keep the fracture open when the treatment is complete. Hydraulic fracturing creates high-conductivity communication with a large area of formation and bypasses any damage that may exist in the near-wellbore area. Furthermore, hydraulic fracturing is used to increase the rate at which fluids, such as petroleum, water, or natural gas can be recovered from subterranean natural reservoirs. Reservoirs are typically porous sandstones, limestones or dolomite rocks, but also include "unconventional reservoirs" such as shale rock or coal beds. Hydraulic fracturing enables the extraction of natural gas and oil from rock formations deep below the earth's surface (e.g., generally 2,000-6,000 m (5,000-20,000 ft)), which is greatly below typical groundwater reservoir levels. At such depth, there may be insufficient permeability or reservoir pressure to allow natural gas and oil to flow from the rock into the wellbore at high economic return. Thus, creating conductive fractures in the rock is instrumental in extraction from naturally impermeable shale reservoirs.

A wide variety of hydraulic fracturing equipment is used in oil and natural gas fields such as a slurry blender, one or more high-pressure, high-volume fracturing pumps and a monitoring unit. Additionally, associated equipment includes fracturing tanks, one or more units for storage and handling of proppant, high-pressure treating iron, a chemical additive unit (used to accurately monitor chemical addition), low-pressure flexible hoses, and many gauges and meters for flow rate, fluid density, and treating pressure. Fracturing equipment operates over a range of pressures and injection rates, and can reach up to 100 megapascals (15,000 psi) and 265 litres per second (9.4 cu ft/s) (100 barrels per minute).

With the wide variety of hydraulic fracturing equipment at a well site, the hydraulic fracturing operation may be conducted. A hydraulic fracturing operation requires planning, coordination, and cooperation of all parties. Safety is always the primary concern in the field, and it begins with a thorough understanding by all parties of their duties. In some methods, hydraulic fracturing operations are dependent on workers being present to oversee and conduct said operation over the full life time to complete said operation.

BRIEF SUMMARY OF THE INVENTION

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a method. The method may include placing a controller in communication with a connector disposed on the wellhead assembly. The method may also include receiving at the controller one or more conditions associated with the connector and a valve of the wellhead assembly. The method may further include operating via the controller at least one of the connector and the valve based on the one or more conditions.

In another aspect, the embodiments disclosed herein relate to a non-transitory computer-readable medium including instructions, executable by a processor. The instructions may include functionality to control a connector coupled to a wellhead assembly. The functionality may include displaying components and commands of the connector on a touch screen in communication with a hydraulic power unit. The functionality may also include collecting data on a state and position of valves in the wellhead assembly and the connector. Additionally, the functionality may include sending commands to unlock, lock, or vent the connector based on the collected data. The functionality may further include opening or closing valves of the wellhead assembly based on the collected data.

In yet another aspect, the embodiments disclosed herein relate to a system. The system may include a connector coupled to a wellhead assembly. The system may also include a hydraulic power unit coupled to the connector and a valve of the wellhead assembly. The system may further include a controller in communication with the connector and the hydraulic power unit. The controller may be operable to receive one or more conditions associated with the connector and a valve of the wellhead assembly. The controller may also be operable to operate at least one of the connector and the valve through the hydraulic power unit based on the one or more condition.

Other aspects and advantages will be apparent from the following description and the appended claims.

DETAILED DESCRIPTION OF THE INVENTION

Figure 1:
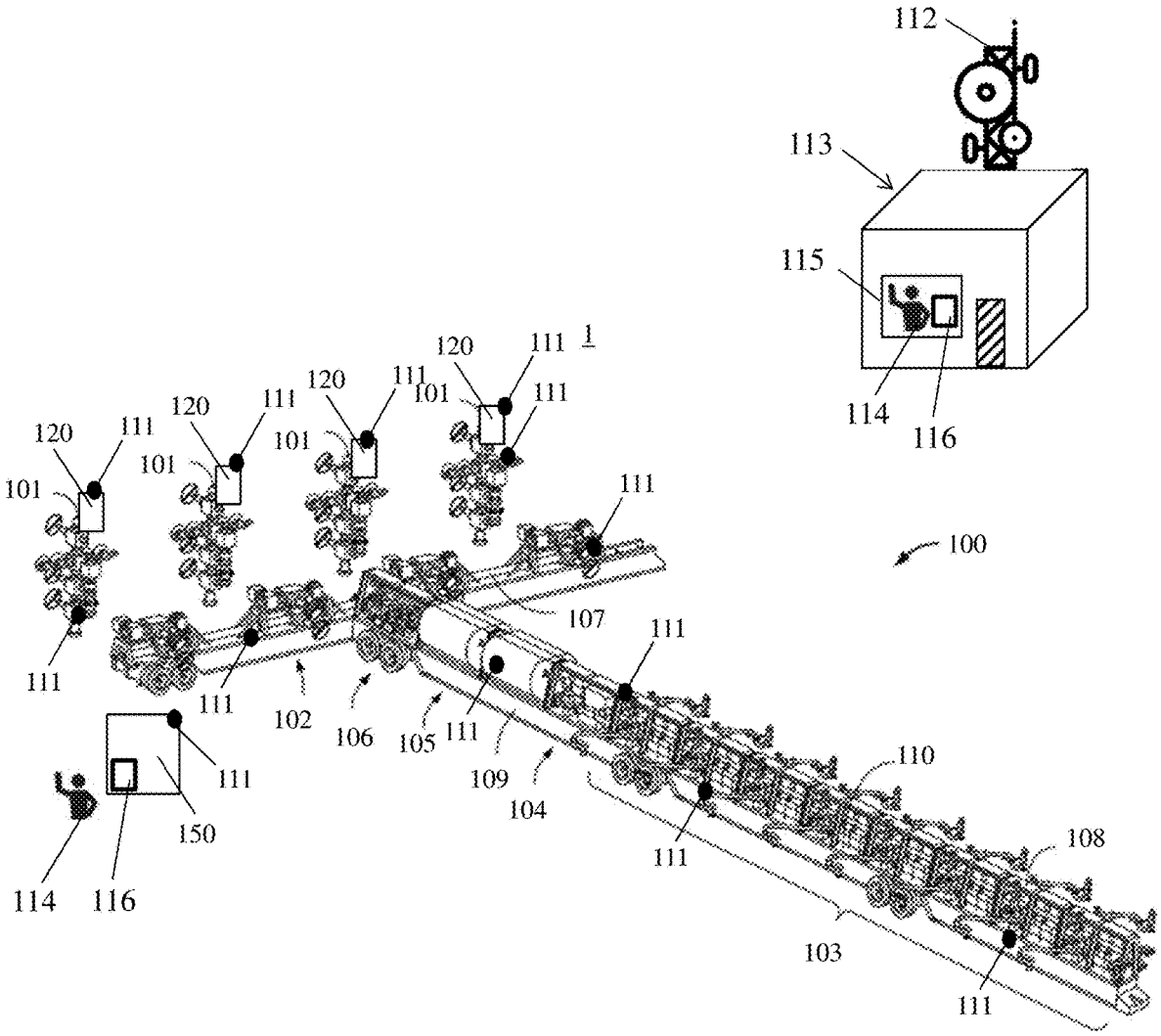
FIG. 1 illustrates a view of a hydraulic fracturing system at a well site according to one or more embodiments of the present disclosure.

Embodiments of the present disclosure are described below in detail with reference to the accompanying figures. Wherever possible, like or identical reference numerals are used in the figures to identify common or the same elements. The figures are not necessarily to scale and certain features and certain views of the figures may be shown exaggerated in scale for purposes of clarification. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description. As used herein, the term "coupled" or "coupled to" or "connected" or "connected to" may indicate establishing either a direct or indirect connection, and is not limited to either unless expressly referenced as such.

Further, embodiments disclosed herein are described with terms designating a rig site in reference to a land rig, but any terms designating rig type should not be deemed to limit the scope of the disclosure. For example, embodiments of the disclosure may be used on an offshore rig and various rig sites, such as land/drilling rig and drilling vessel. It is to be further understood that the various embodiments described herein may be used in various stages of a well, such as rig site preparation, drilling, completion, abandonment etc., and in other environments, such as work-over rigs, fracking installation, well-testing installation, and oil and gas production installation, without departing from the scope of the present disclosure. Further, fluids may refer to slurries, liquids, gases, and/or mixtures thereof. In some embodiments, solids may be present in the fluids. The embodiments are described merely as examples of useful applications, which are not limited to any specific details of the embodiments herein.

In a fracturing operation, a plurality of equipment (i.e., fracturing equipment) is disposed around a rig site to perform a wide variety of fracturing operations during a life of the fracturing operation (i.e., rig site preparation to fracturing to removal of fracturing equipment) and form a built hydraulic fracturing system. At the site, there is a wide variety of fracturing equipment for operating the fracturing, such as, a slurry blender, one or more high-pressure, high-volume fracturing pumps a monitoring unit, fracturing tanks, one or more units for storage and handling of proppant, high-pressure treating iron, a chemical additive unit (used to accurately monitor chemical addition), low-pressure flexible hoses, and many gauges and meters for flow rate, fluid density, treating pressure, etc. The fracturing equipment encompasses a number of components that are durable, sensitive, complex, simple components, or any combination thereof. Furthermore, it is also understood that one or more of the fracturing equipment may be interdependent upon other components. Once the fracturing equipment is set up, typically, the fracturing operation may be capable of operating 24 hours a day. Additionally, the wide variety of hydraulic fracturing equipment includes a tree or wellhead for fracturing or wireline operations. A connector may be disposed on the tree or wellhead to allows for an attached of various equipment to the tree or wellhead. In some methods, the connector is manually operated and monitored.

Conventional hydraulic fracturing systems in the oil and gas industry typically require an entire team of workers to ensure proper sequencing. For example, a valve team may meet, plan, and agree on a valve sequence to then actuate the valves. As a result, conventional hydraulic fracturing systems are prone to human errors resulting in improper actuation of valves and expensive damage and non-productive time (NPT). In addition, there is no automated log of valve phases and operational information as conventional hydraulic fracturing systems are monitored by workers. As such, conventional hydraulic fracturing systems may fail to have real-time information on how long an activity lasted/duration and data supporting operational improvement or how many times valves have been actuated to determine maintenance requirements or service requirements.

One or more embodiments in the present disclosure may be used to overcome such challenges as well as provide additional advantages over conventional hydraulic fracturing systems. For example, in some embodiments, a controller in communication with a quick connect/disconnect ("QCD") connector coupled to a hydraulic power unit ("HPU") described herein and a plurality of sensors working in conjunction with built wellhead or frac tree may streamline and improve efficiency as compared with conventional hydraulic fracturing systems due, in part, to reducing or eliminating human interaction with the hydraulic fracturing systems by automating fracturing operations, monitoring, logging and alerts. The QCD connector may be interchangeably referred to as a connector.

In one aspect, embodiments disclosed herein relate to automating a QCD connector that may perform multiple processes in hydraulic fracturing and wireline operations. The QCD connector may improve safety and efficiency of the hydraulic fracturing and wireline operation. For example, the QCD connector may be hydraulically actuated and remotely operated. In some embodiments, the QCD connector is remotely operated from outside a red-zone (i.e., approximate site location of equipment) during fracturing operations. In addition, the QCD connector may be automated and operate in conjunction with an automated HPU. Automating the QCD connector and HPU system according to one or more embodiments described herein may provide a cost effective alternative to conventional hydraulic fracturing systems. Additionally, the automating the QCD connector and HPU system further aids in ensuring that the QCD connector will not disengage under pressure. Further, information is provided through the automating the QCD connector and HPU system such that an engagement of the QCD connector to the tree or wellhead may be confirmed to avoid disengagement under pressure. Furthermore, information on stages of wireline operations may be provided to the automating the QCD connector and HPU system to provide safeguards to prevent cutting wireline. It is further envisioned that, with the QCD connector and HPU system, pressures across the valves in wellhead are known to provide safeguards to prevent damage to wirelines. In some case, the QCD connector and HPU system may have positive confirmation of wireline that is above the tree valves and does not need a momentary key, which is only turned by a wireline operator. The embodiments are described merely as examples of useful applications, which are not limited to any specific details of the embodiments herein.

FIG. 1 shows a hydraulic fracturing system according to embodiments of the present disclosure. The hydraulic fracturing system includes a built hydraulic fracturing system 100 having a plurality of connected together fracturing equipment at a rig site 1. The built hydraulic fracturing system 100 may include at least one wellhead assembly 101 (e.g., a tree) coupled to at least one time and efficiency (TE) or zipper manifold 102 through one or more flow lines (not shown). In addition, a quick connect/disconnect ("QCD") connector 120 may be coupled at a top of each of the wellhead assembly 101. The QCD connector 120 may have a lubricator tool attached thereof and the combined structure (e.g., QCD connector 120 with the lubricator tool) is transported with a crane to be coupled to the wellhead assembly 101. The QCD connector 120 may be stabbed into an adapter on the wellhead assembly 101, and locking dogs may be engaged to establish a high pressure connection. It is further envisioned that the QCD connector 120 may have built in pressure and position sensors to determine bore pressure for connect/disconnect operations and position sensors to determine engaged or disengaged status of the QCD connector 120 on the wellhead assembly 101. One skilled in the art will appreciate how the QCD connector 120 may be hydraulic and remotely activated to connect and disconnect wireline lubricators to the wellhead assembly 101 without any human intervention. The QCD connector 120 may further eliminate human interface and field exposure during wireline or coil tubing during frac operations.

The hydraulic fracturing system 100 may further include at least one pump manifold 103 in fluid communication with the zipper manifold 102. In use, the at least one pump manifold 103 may be fluidly connected to and receive pressurized fracking fluid from one or more high pressure pumps (not shown), and direct that pressurized fracking fluid to the zipper manifold 102, which may include one or more valves that may be closed to isolate the wellhead assembly 101 from the flow of pressurized fluid within the zipper manifold 102 and pump manifold 103. Additionally, the at least one wellhead assembly 101 may include one or more valves fluidly connected to a wellhead that are adapted to control the flow of fluid into and out of wellhead. Typical valves associated with a wellhead assembly include, but are not limited to, upper and lower master valves, wing valves, and swab valves, each named according to a respective functionality on the wellhead assembly 101.

Additionally, the valves of the at least one wellhead assembly 101 and zipper manifold 102 may be gate valves that may be actuated, but not limited to, electrically, hydraulically, pneumatically, or mechanically. In some embodiments, the built hydraulic fracturing system 100 may include a system 150 (i.e., Hydraulic Power Unit ("HPU")) that may provide power to actuate the valves of the built hydraulic fracturing system 100. In a non-limited example, when the valves are hydraulically actuated, the HPU 150 may include a hydraulic skid with accumulators to provide the hydraulic pressure required to open and close the valves, when needed. The HPU 150 may also be interchangeably referred to as a valve control system in the present disclosure. It is further envisioned that the HPU 150 may operate the QCD connector 120, and swab valve, lower master valve, upper master valve, and wing valve on the wellhead assembly 101 to ensure maximum safety and operational efficiency. The HPU 150 is automated, the HPU 150 may receive feedback from tree valve position sensors to determine which sequence of valves are in open or close position. In addition, the HPU 150 may determine if current a well is in Standby, Frac or Wireline operation and pneumatically locks operation to specific valves based on field specific SOP to ensure safe operation. It is further envisioned that the HPU 150 may be a standard hydraulic power unit commonly known as the Kumi and be retrofitted with sensors, solenoids and pneumatic actuators.

In one or more embodiments, the QCD connector 120 in conjunction with the HPU 150 may have a function on a controller to open and close valves electronically. Additionally, the controller may "Lock Out" the QCD connector 120 on the wellhead assembly 101 such that the controller may release the QCD connector 120 by request or if a fault is triggered. Further, the controller may obtain information (e.g., air pressure, hydraulic pressure and power failure) to determine a right course of action. Furthermore, a detection of a valve state based on the valve handle position may be obtained by the controller through the QCD connector 120. It is further envisioned that the QCD connector 120 may include a supervisory option to lockout a valve.

Further, the built hydraulic fracturing system 100 includes a plurality of additional rig equipment for fracturing operations. In a non-limiting example, the built hydraulic fracturing system 100 may include at least one auxiliary manifold 104, at least one pop-off/bleed-off tank manifold 105, at least one isolation manifold 106, and/or a spacer manifold 107. The at least one pump manifold 103 may be used to inject a slurry into the wellbore in order to fracture the hydrocarbon bearing formation, and thereby produce channels through which the oil or gas may flow, by providing a fluid connection between pump discharge and the hydraulic fracturing system 100. The auxiliary manifold 104 may provide a universal power and control unit, including a power unit and a primary controller of the hydraulic fracturing system 100. The at least one pop-off/bleed-off tank manifold 105 may allow discharge pressure from bleed off/pop off operations to be immediately relieved and controlled. The at least one isolation manifold 106 may be used to allow pump-side equipment and well-side equipment to be isolated from each other. The spacer manifold 107 may provide spacing between adjacent equipment, which may include equipment to connect between the equipment in the adjacent manifolds.

In one or more embodiments, the manifolds 102, 103, 104, 105, 106, 107 may each include a primary manifold connection 110 with a single primary inlet and a single primary outlet and one or more primary flow paths extending therebetween mounted on same-sized A-frames 108. Additionally, the built hydraulic fracturing system 100 may be modular to allow for easy transportation and installation on the rig site. In a non-limiting example, the built hydraulic fracturing system 100 in accordance with the present disclosure may utilize the modular fracturing pad structure systems and methods, according to the systems and methods as described in U.S. patent application Ser. No. 15/943,306, which the entire teachings of are incorporated herein by reference. In a non-limiting example, the built hydraulic fracturing system 100 in accordance with the present disclosure may utilize an automated hydraulic fracturing system and method. While not shown by FIG. 1, one of ordinary skill in the art would understand the built hydraulic fracturing system 100 may include further equipment, such as, a blowout preventer (BOP), completions equipment, topdrive, automated pipe handling equipment, etc. Further, the built hydraulic fracturing system 100 may include a wide variety of equipment for different uses; and thus, for the purposes of simplicity, the terms "plurality of devices" or "rig equipment" are used hereinafter to encompass the wide variety equipment used to form a built hydraulic fracturing system comprising a plurality of devices connected together.

Still referring to FIG. 1, the built hydraulic fracturing system 100 may further include a plurality of sensors 111 provided at the rig site 1. The plurality of sensors 111 may be associated with some or all of the plurality of devices of the built hydraulic fracturing system 100, including components and subcomponents of the devices. In a non-limiting example, some of the plurality of sensors 111 may be associated with each of the valves of the wellhead assembly 101, the QCD connector 120, the HPU 150, and the zipper manifold 102. The plurality of sensors 111 may be a microphone, ultrasonic, ultrasound, sound navigation and ranging (SONAR), radio detection and ranging (RADAR), acoustic, piezoelectric, accelerometers, temperature, pressure, weight, position, or any sensor in the art to detect and monitor the plurality of devices. The plurality of sensors 111 may be disposed on the plurality of devices at the rig site 1 and/or during the manufacturing of said devices. It is further envisioned that the plurality of sensors 111 may be provided inside a component of the plurality of devices. Additionally, the plurality of sensors 111 may be any sensor or device capable of wireline monitoring, valve monitoring, pump monitoring, flow line monitoring, accumulators and energy harvesting, and equipment performance and damage.

The plurality of sensors 111 may be used to collect data on status, process conditions, performance, and overall quality of the device that said sensors are monitoring, for example, on/off status of equipment, open/closed status of valves, pressure readings, temperature readings, and others. One skilled in the art will appreciate the plurality of sensors 111 may aid in detecting possible failure mechanisms in individual components, approaching maintenance or service, and/or compliance issues. In some embodiments, the plurality of sensors 111 may transmit and receive information/instructions wirelessly and/or through wires attached to the plurality of sensors 111. In a non-limiting example, each sensor of the plurality of sensors 111 may have an antenna (not shown) to be in communication with a master antenna 112 on any housing 113 at the rig site 1. The housing 113 may be understood to one of ordinary skill to be any housing typically required at the rig site 1 such as a control room where an operator 114 may be within to operator and view the rig site 1 from a window 115 of the housing 113. It is further envisioned that the plurality of sensors 111 may transmit and receive information/instructions from a remote location away from rig site 1. In a non-limiting example, that the plurality of sensors 111 may collect signature data on the plurality of devices and deliver a real-time health analysis of plurality of devices.

In one aspect, a plurality of sensors 111 may be used to record and monitor the hydraulic fracturing equipment to aid in carrying out the fracturing plan. Additionally, data collected from the plurality of sensors 111 may be logged to create real-time logging of operational metric, such as duration between various stages and determining field efficiency. In a non-limiting example, the plurality of sensors 111 may aid in monitoring a valve position to determine current job state and provides choices for possible stages. In some examples, the plurality of sensors may provide information such that a current state of the hydraulic fracturing operation, possible failures of hydraulic fracturing equipment, maintenance or service requirements, and compliance issues that may arise is obtained. By obtaining such information, the automated hydraulic fracturing systems may form a closed loop valve control system, valve control and monitoring without visual inspection, and reduce or eliminate human interaction with the hydraulic fracturing equipment.

An automated hydraulic fracturing system may include a computing system for implementing methods disclosed herein. The computing system may include an human machine interface ("HMI") using a software application and may be provided to aid in the automation of a built hydraulic fracturing system. In some embodiments, an HMI 116, such as a computer, control panel, and/or other hardware components may allow the operator 114 to interact through the HMI 116 with the built hydraulic fracturing system 100 in an automated hydraulic fracturing system. The HMI 116 may include a screen, such as a touch screen, used as an input (e.g., for a person to input commands) and output (e.g., for display) of the computing system. In some embodiments, the HMI 116 may also include switches, knobs, joysticks and/or other hardware components which may allow an operator to interact through the HMI 116 with the automated hydraulic fracturing systems. The HMI 116 is further described in FIGS. 8A and 8B.

An automated hydraulic fracturing system, according to embodiments herein, may include the plurality of sensors 111, HPU 150, and data acquisition hardware disposed on or around the hydraulic fracturing equipment, such as on valves, pumps and pipelines. In some embodiments, the data acquisition hardware is incorporated into the plurality of sensors 111. In a non-limiting example, hardware in the automated hydraulic fracturing systems such as sensors, wireline monitoring devices, valve monitoring devices, pump monitoring devices, flow line monitoring devices, hydraulic skids including accumulators and energy harvesting devices, may be aggregated into single software architecture.

The plurality of sensors 111 work in conjunction with the computer system to display information on the HMI 116. For example, the plurality of sensors 111 may measure a differential pressure in valves of the wellhead assembly 101 and the QCD connector 120. The differential pressure may be an air pressure, a hydraulic pressure, and/or a fluid pressure within the valves. The plurality of sensors 111 may then transmit the measured differential pressure to the computer system and be displayed on the HMI 116. By knowing the differential pressure, the computer system may send alerts, over the HMI 116, to inform the operator 114 on a course of action to be performed on the wellhead assembly 101 and the QCD connector 120. In some embodiments, the computer system may automatically proceed with the course of action to be performed on the wellhead assembly 101 and the QCD connector 120. It is further envisioned that a log is keep by the computer system to determine if the values are calibrated and may send alerts or automatically calibrate the valves.

Having the hydraulic fracturing system, as described in FIG. 1 and herein, may significantly improve overall performance of the rig, rig safety, reduced risk of NPT and many other advantages. Embodiments of the present disclosure describe control systems, measurements, and strategies to automating rig operation (e.g., fracturing operations). It is further envisioned that the hydraulic fracturing system may locally collect, analyze, and transmit data to a cloud in real-time to provide information, such as equipment health, performance metrics, alerts, and general monitoring, to third parties remotely or through the HMI 116.

Figure 2:
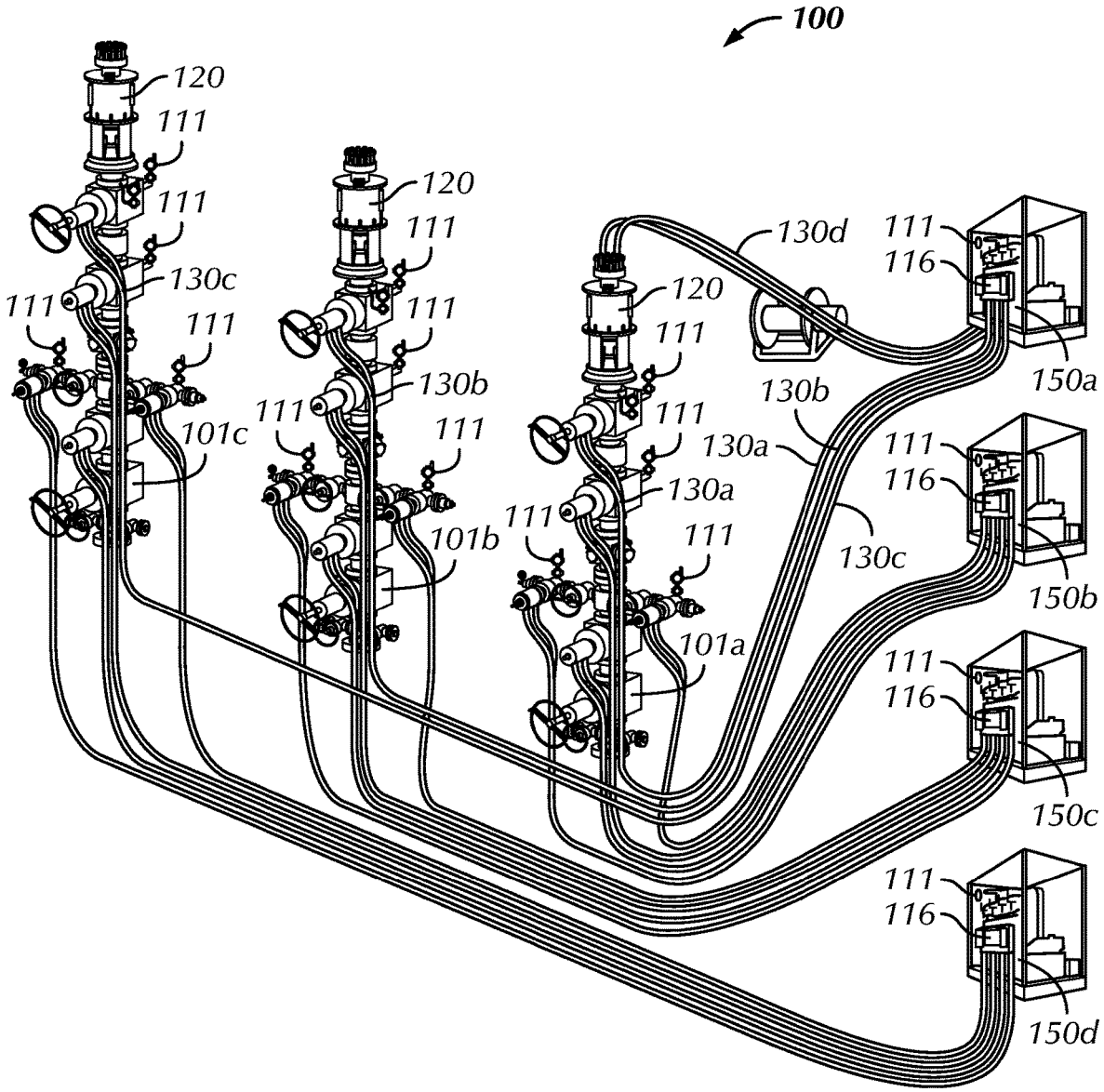
FIGS. 2 and 3 illustrate a view of a wellhead assembly of the hydraulic fracturing system of FIG. 1 according to one or more embodiments of the present disclosure.
Figure 3:
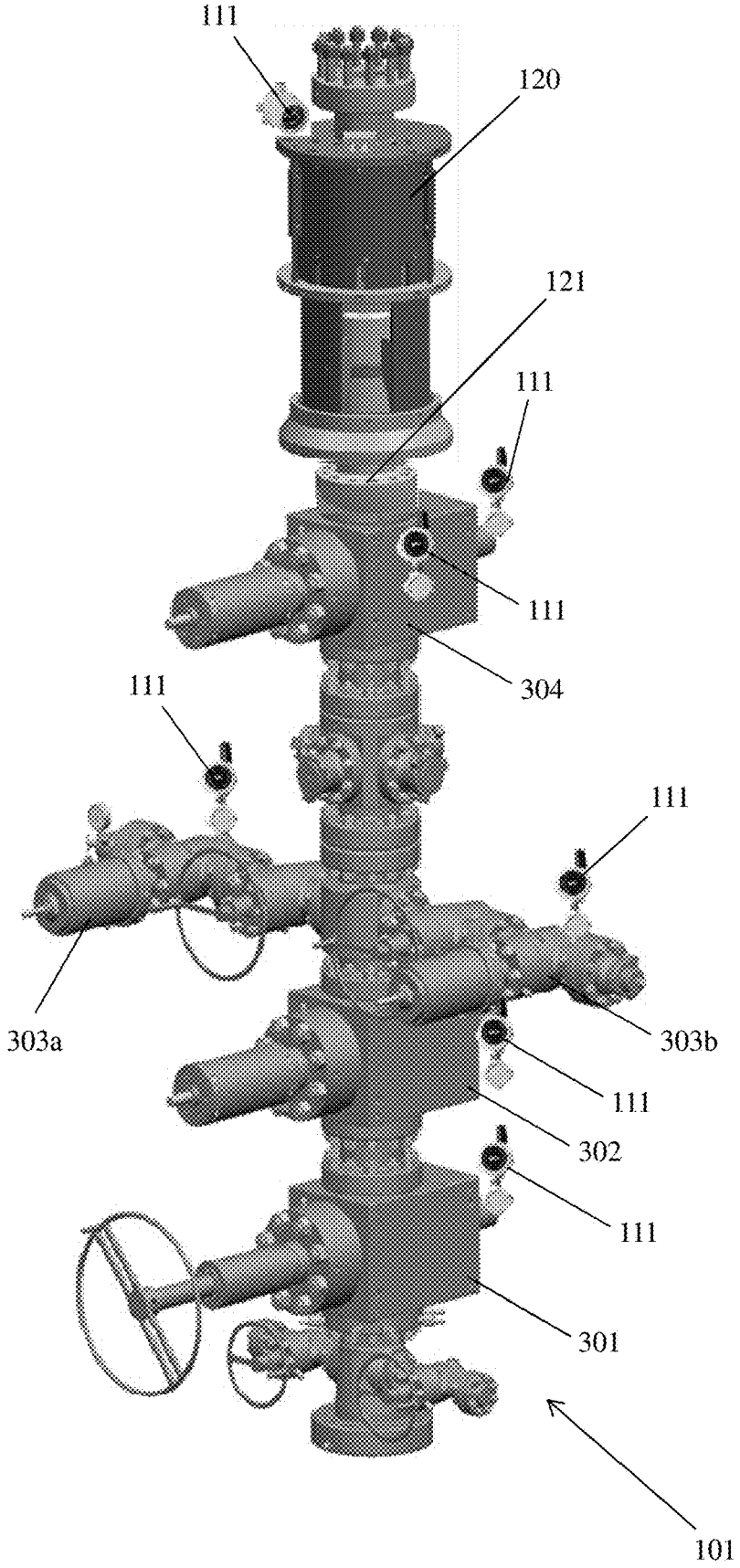

Now referring to FIGS. 2 and 3, in one or more embodiments, the wellhead assembly 101 and the QCD connector 120 of the built hydraulic fracturing system 100 shown in FIG. 1 is illustrated according to embodiments of the present disclosure. The QCD connector 120 coupled to the wellhead assembly 101 may form a frac tree assembly (101*a*, 101*b*, 101*c*). As shown in FIG. 3, in one or more embodiments, one or more HPU 150 may be connected to the frac tree assembly (101, 201) via a plurality of power lines 130. For example, a first power line 130*a* may connect a first HPU 150*a* to a first frac tree assembly 101*a*, a second power line 130*b* may connect the first HPU 150*a* to a second frac tree assembly 101*b*, and a third power line 130*c* may connect the first HPU 150*a* to a third frac tree assembly 101*c*. Additionally, the first HPU 150*a* may a fourth power line 130*d* connected to a top of the QCD connector 120 of the first frac tree assembly 101*a*. It is further envisioned that a second HPU 150*b*, a third HPU 150*c*, a fourth HPU 150*d* may have power lines 130 directly attached to various components (i.e., swab valve, lower master valve, upper master valve, and wing valve") of the corresponding frac tree assembly (101*a*, 101*b*, 101*c*). As shown in FIGS. 2 and 3, in one or more embodiments, each component of the frac tree assembly (101, 120) may have a sensor (111) disposed on or within thereof. Additionally, the QCD connector 120 may be coupled to an adaptor 121 on top of the wellhead assembly 101.

As shown in FIG. 3, the wellhead assembly 101 may include a lower master valve 301, an upper master valve 302, a wing valve (303*a*, 303*b*), and a swab valve 304. The lower master valve 301 and the upper master valve 302 lie within the flow path from the well such that reservoir and injection fluids must flow through the lower master valve 301 and the upper master valve 302. Either the lower master valve 301 or the upper master valve 302 may be used on a routine basis, while the other valve provides backup or contingency function in the event that the routinely used valve is damaged or needs repairs. The wing valve (303*a*, 303*b*) may extend off an axis of the wellhead assembly 101. The wing valve (303*a*, 303*b*) may have a first wing valve 303*a* to allow for a flow path of the reservoir fluids to exit the wellhead assembly 101 and a second wing valve 303*b* for injection fluids, such as frac fluids, to enter the wellhead assembly 101. The swab valve 304 may be a topmost valve on the wellhead assembly 101 that provides vertical access to the wellbore. Additionally, the swab valve 304 may be used in well intervention operations such as those using wireline and coiled tubing. The controller in communication with the QCD connector 120 in conjunction with the HPU 150 and the plurality of sensors 111 may have a function to operate the valves (301, 302, 303*a*, 303*b*, 304) to reduce or eliminate human interaction with the frac tree assembly (101, 120) by automating fracturing operations, monitoring, logging and alerts.

Figure 4A:
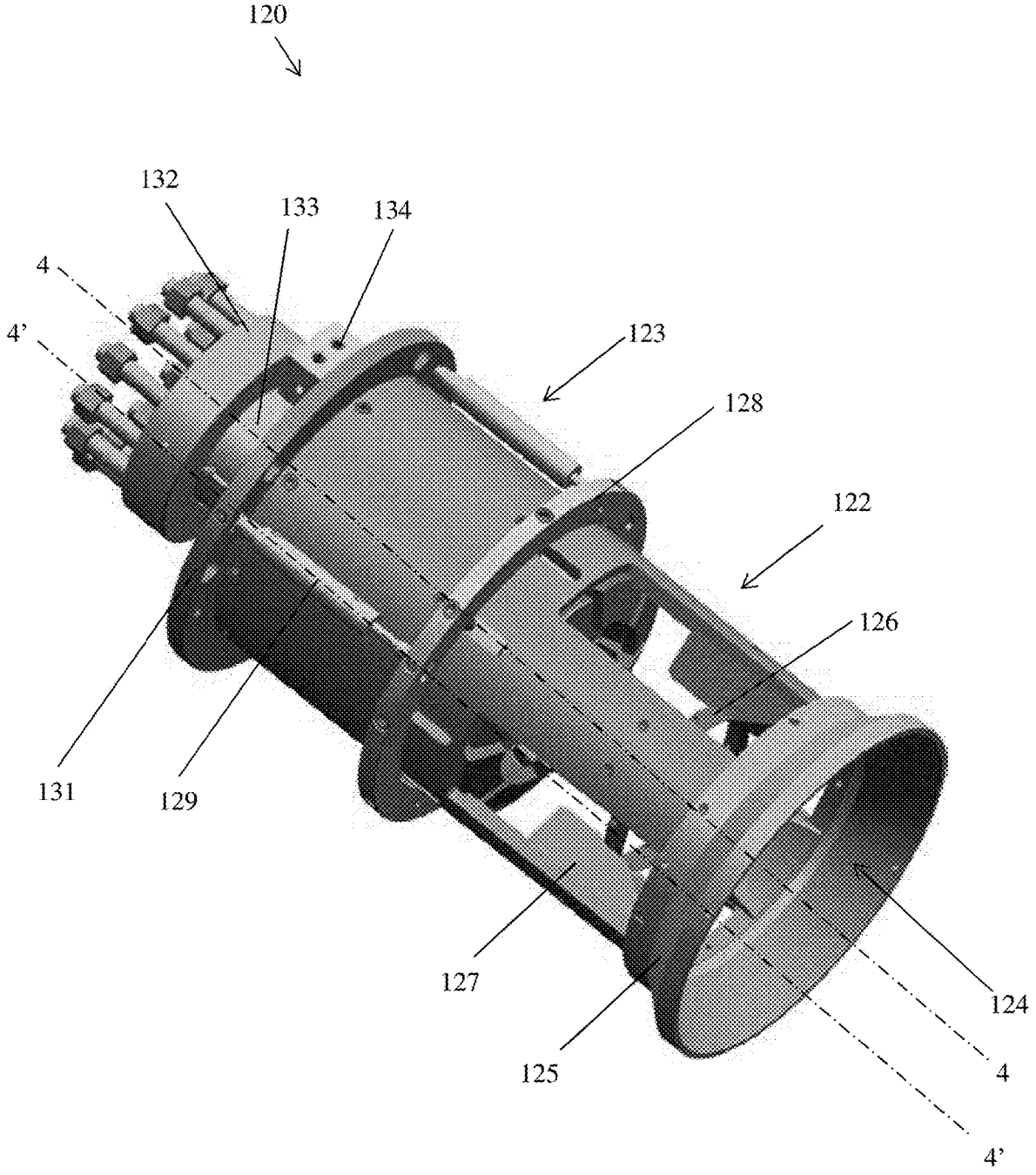
FIGS. 4A-4C illustrate views of a quick connect/disconnect ("QCD") connector of FIGS. 1-3 according to one or more embodiments of the present disclosure.

With reference to FIG. 4A, in one or more embodiments, FIG. 4A shows a perspective view of the QCD connector 120 of the built hydraulic fracturing system 100 shown in FIGS. 1-3 is illustrated according to embodiments of the present disclosure. The QCD connector 120 may have a first portion 122 and a second portion 123 separated by middle ring 128. The first portion 122 may have an opening 124 and a lower ring 125 at an end of the QCD connector 120. Additionally, a plurality of blocks 127 may be attached to an inner surface of the first portion 122. The plurality of blocks 127 may hold a seal ring 126. The second portion 123 may include a plurality of hydraulic cylinders 129 extending from the middle ring 128 to a top ring 131. Further, cylinder manifolds 134 of the plurality of hydraulic cylinders 129 may be disposed in on the top ring 131. In addition, a flanged connection 132 may be coupled to a stab body 133 extending outwardly from the second portion 123 of the QCD connector 120. For example, the flanged connection 132 may be a rotating flange.

Figure 4B:
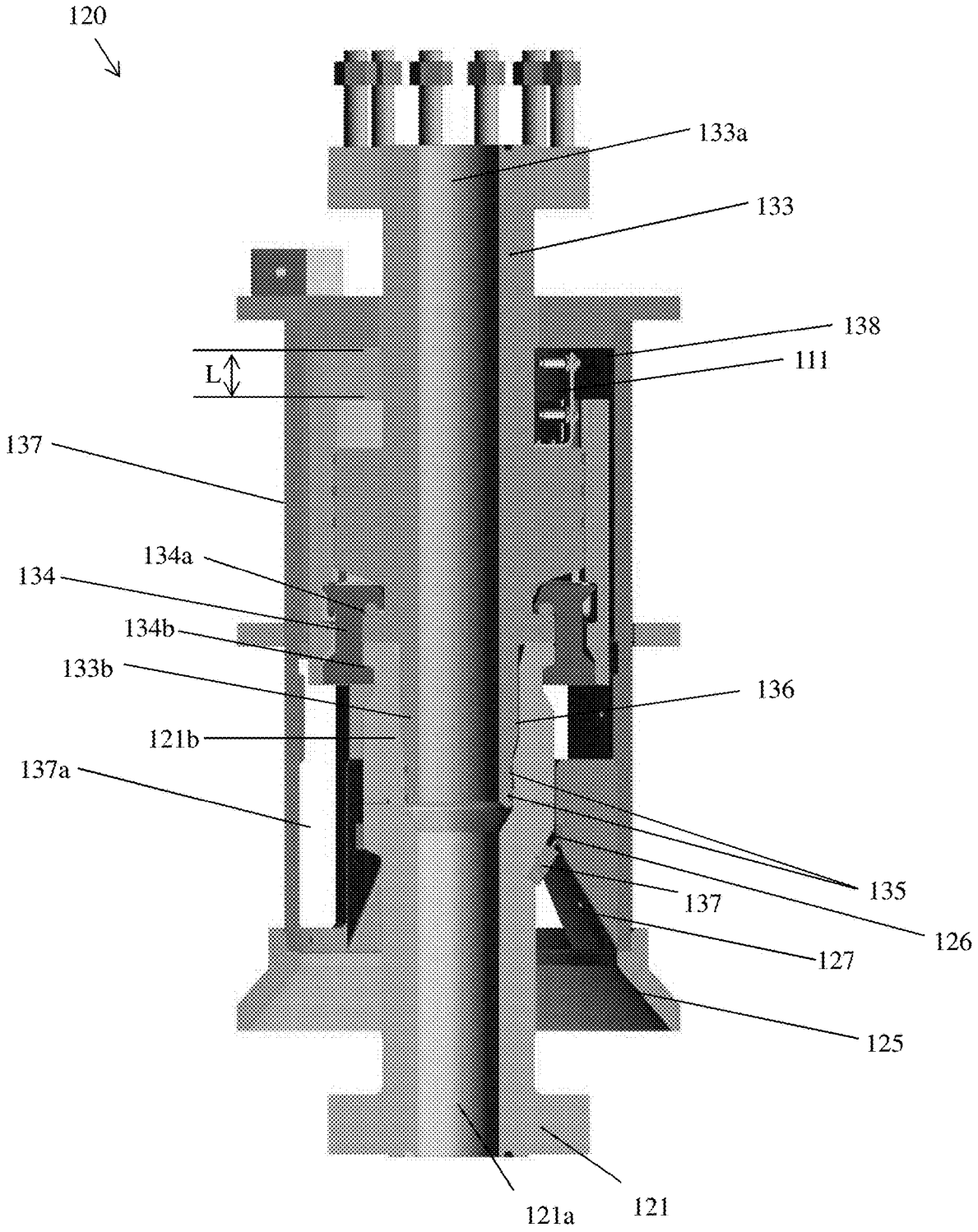

Referring to FIG. 4B, in one or more embodiments, a cross-sectional view of the QCD connector 120 taken along line 4-4 in FIG. 4A. FIG. 4B illustrates the QCD connector 120 locked on the adaptor 121. An adaptor bore 121*a* may be coaxial with a bore 133*a* of the stab body 133 of the QCD connector 120. For example, the stab body 133 may have a pin end 133*b* which is inserted or stabbed into a female end 121*b* of the adaptor 121. When the stab body 133 is inserted or stabbed, the stab body may retract a stroke length L within the QCD connector 120. The pin end 133*b* may have a dual seal 135 and an alignment feature 136 to align the stab body 133 with the adaptor 121. Further, the lower ring 125 and the plurality of blocks 127 may be angled to act as addition alignment features. It is further envisioned that the adaptor 121 may have a mechanical switch/land indication 137 which may engage the seal ring 126 and the plurality of blocks 127. In addition, locking dogs 134 of the QCD connector 120 engage an outer surface of the stab body 133 and the adaptor 121 to lock each other together. For example, the locking dogs 134 may have a first shoulder 134*a* locked on the stab body 133 and a second shoulder 134*b* locked on the adaptor 121. It is further envisioned that the QCD connector 120 may have a protective body 137 surrounding the internal components. The protective body 137 may further include a plurality of windows 137*a* to allow for visual confirmation of the stab body 133 and the adaptor 121 engagement. Additionally, the QCD connector 120 may have a slot 138 for the sensor 111 to be disposed within.

Figure 4C:
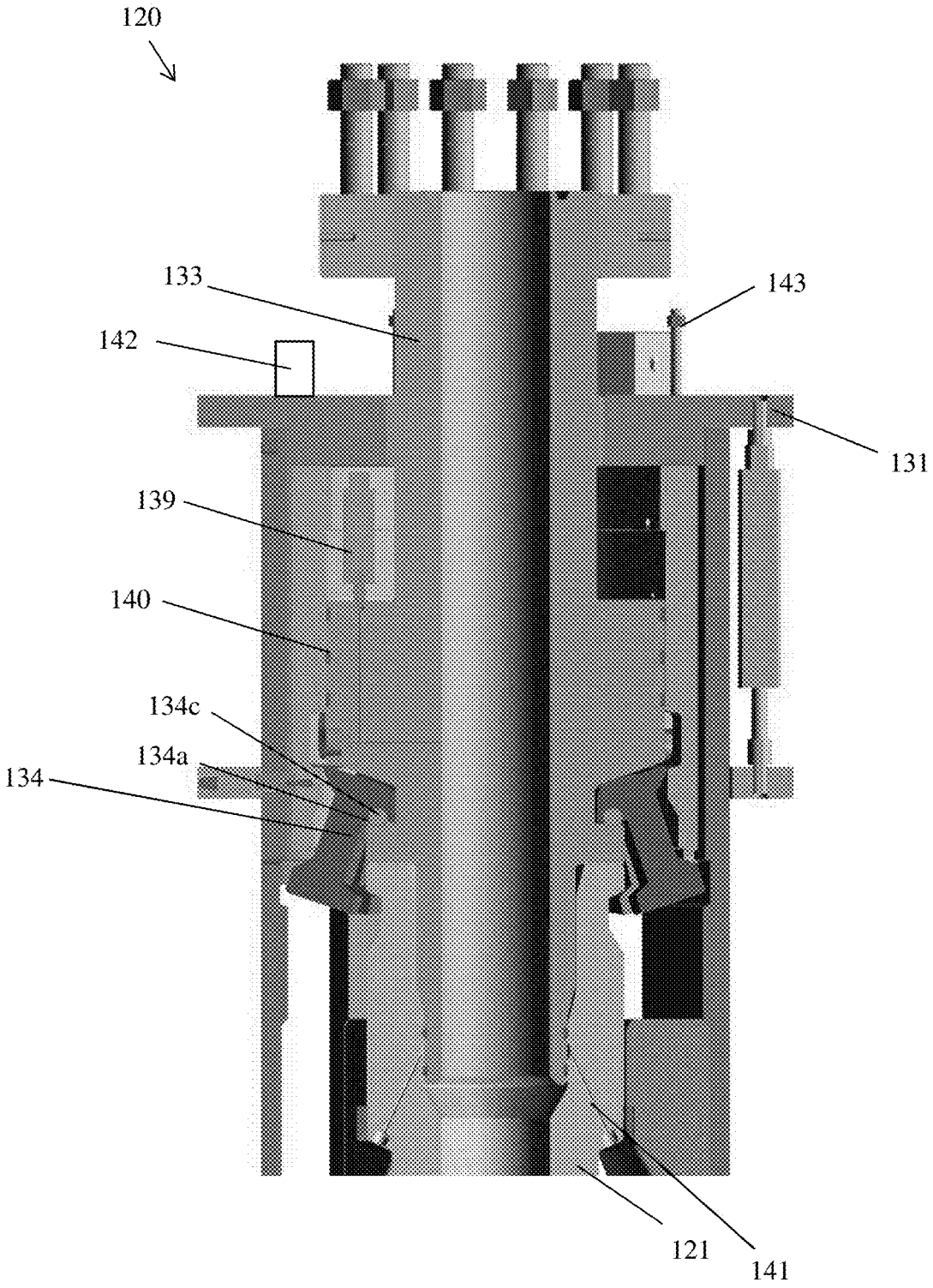

Referring to FIG. 4C, in one or more embodiments, a cross-sectional view of the QCD connector 120 taken along line 4'-4' in FIG. 4A. FIG. 4C, in one or more embodiments, illustrates the QCD connector 120 unlocked on the adaptor 121. For example, the locking dogs 134 may rotate about a bearing 134*c* on the first shoulder 134*a* such that the second shoulder 134*b* does not engage with the adaptor 121. Additionally, the QCD connector 120 may be provide with a pressure transducer 139 to pressurize secondary seals 140 on the stab body 133. In some embodiments, the adaptor 121 may be provided with seal test ports 141. It is further envisioned that a transmitter package 142 and a mechanical unlock/visual indicator 143 may be disposed on top of the top ring 131.

Figure 5:
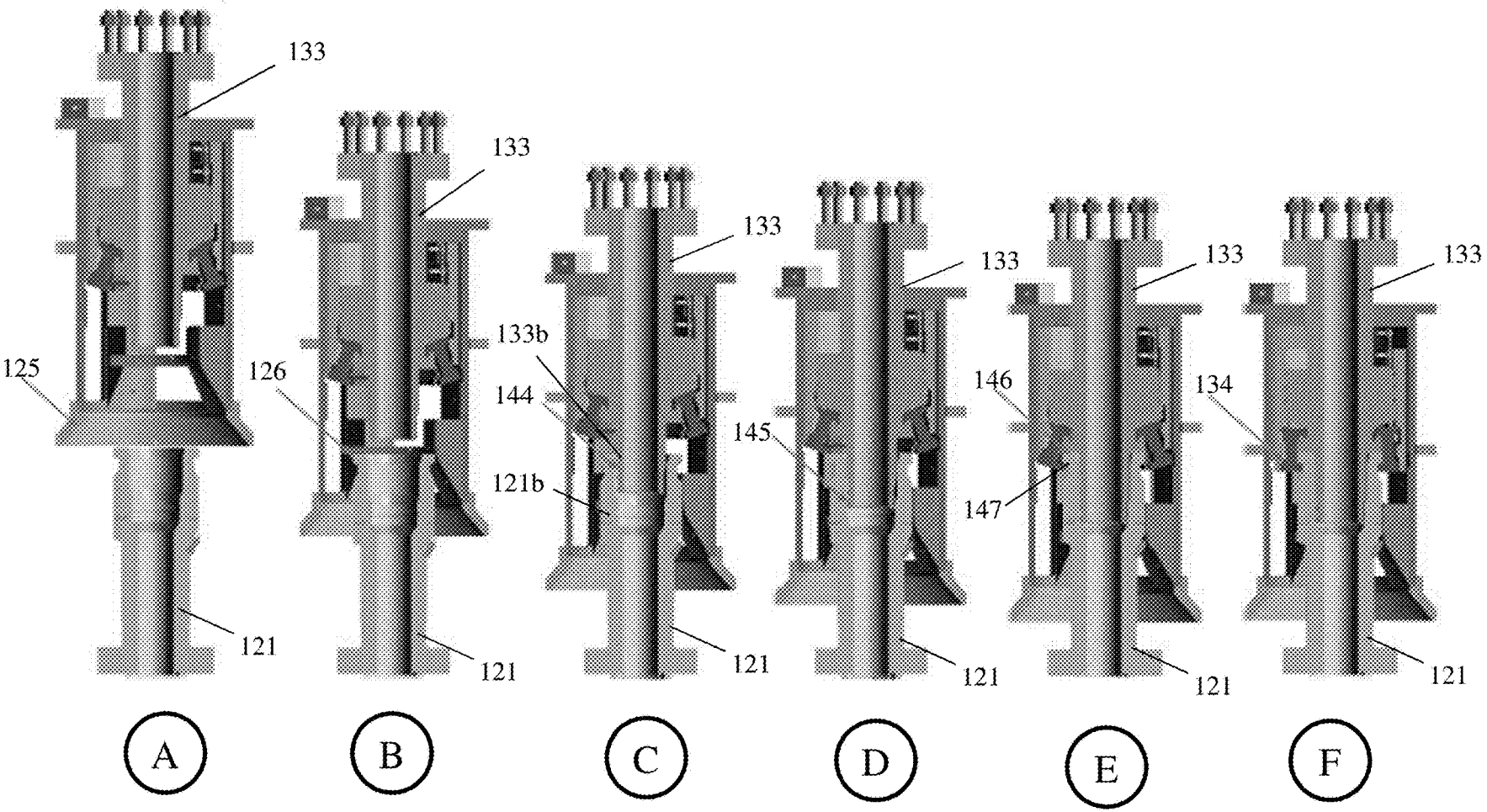
FIG. 5 illustrates a view of installing a quick connect/disconnect ("QCD") connector according to one or more embodiments of the present disclosure.

With reference to FIG. 5, FIG. 5 shows a non-limiting example of a running sequence (A-F) to land the QCD connector 120 onto the adaptor 121. The running sequence may start at a first step A in which the QCD connector 120 is in standby mode and the lower ring 125 of the QCD connector 120 is just above the adaptor 121. In a second step B, the QCD connector 120 is lowered such that the seal ring 126 of the QCD connector 120 contacts the adaptor 121. In a third step C, the QCD connector 120 is further lowered such that the pin end 133*b* of the stab body 133 is within a first bore 144 of the female end 121*b* of the adaptor 121. In a fourth step D, the stab body 133 of the QCD connector 120 is further lowered such that the pin end 133*b* of the stab body 133 moves past the first bore 144 and into a second bore 145 of the female end 121*b* of the adaptor 121. Now in a fifth step E, the QCD connector 120 is further lowered such that an inner shoulder 146 of the stab body 133 lands on a load shoulder 147 of the adaptor 121. In a sixth step F, the locking dogs 134 rotate to lock the stab body 133 onto the adaptor 121. It is further envisioned that the HPU (150) may have controller to automatically perform the running sequence (A-F).

Figure 6:
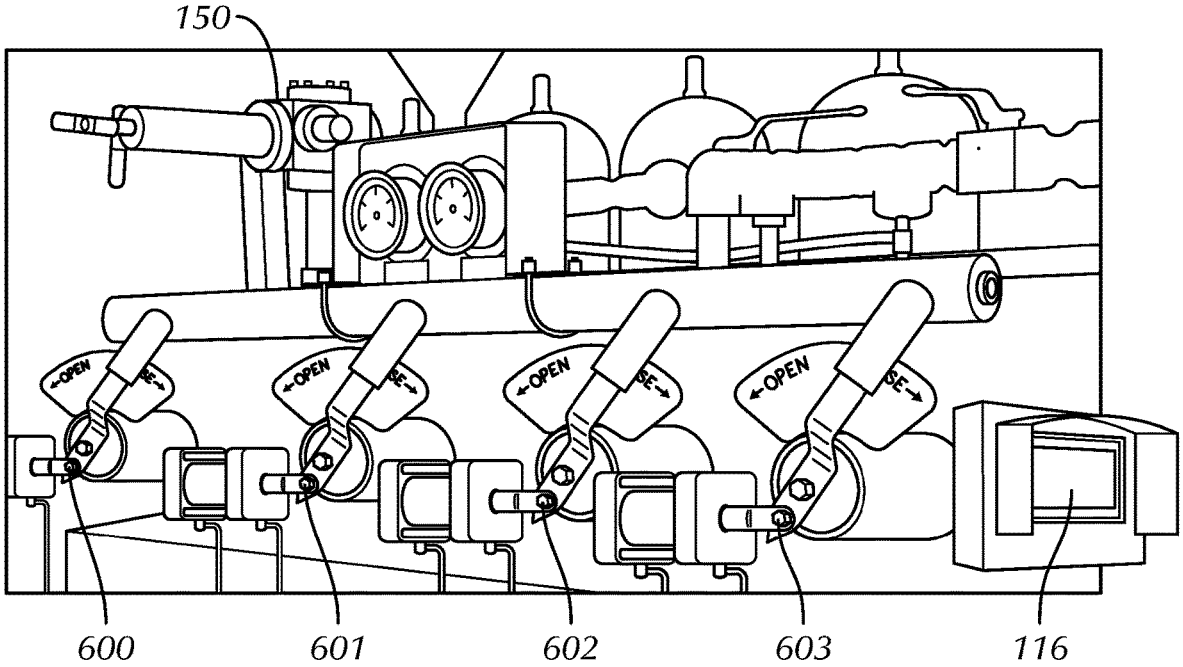
FIG. 6 illustrates a view of a hydraulic power unit ("HPU") of the hydraulic fracturing system of FIGS. 1 and 2 according to one or more embodiments of the present disclosure.

Now referring to FIG. 6, in one or more embodiments, FIG. 6 shows a non-limiting example of the HPU 150 according to embodiments of the present disclosure. The HPU 150 may include individual controls for various components of the frac tree assembly (101, 201). For example, the HPU 150 may be provided with a QCD connector control 600, a first tree valve control 601, a second tree valve control 602, and a third tree valve control 603. Additionally, the HPU 150 may be provided with HMI 116 in which the all the controls (600, 601, 602, 603) may be controlled and accessed by a controller.

Figure 7:
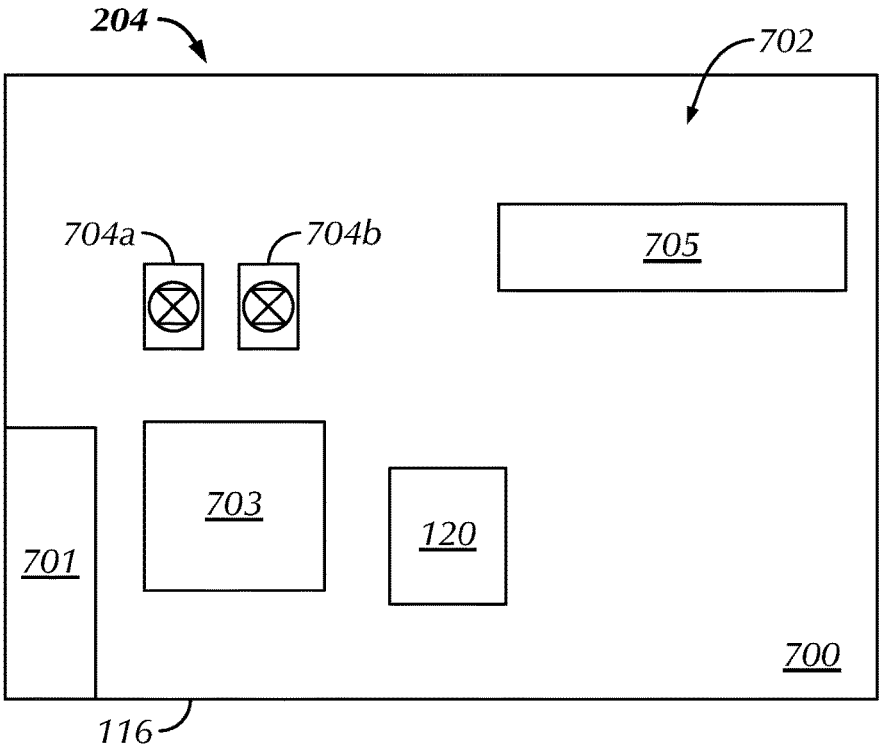
FIG. 7 illustrates a view of a human machine interface ("HMI") of the hydraulic fracturing system of FIGS. 1, 2, and 6 according to one or more embodiments of the present disclosure.

With reference to FIG. 7, FIG. 7 shows a non-limiting example of an automated QCD connector displayed on the HMI 116. The HMI 116 may include a touch screen 700 with a scroll down menu 701 to select an operation. when an operation is selected, the HMI 116 may display a plurality of equipment/devices 702 of a hydraulic fracturing system arranged and connected together as they would be in the built hydraulic fracturing system (see 100 of FIG. 1). For example, the components of the QCD connector 120 may be displayed on the HMI 116. Additionally, a function section 703 of the touch screen 700 may display commands to send to the QCD connector 120. The function section 703 may include a command to unlock, lock or vent the QCD connector 120. The HMI 116 may further show positions of devices being monitored and/or controlled through the system. In a non-limiting example, the simulation may display the open and closed positions of valves (e.g., see 704*a* for open and 701*b* for closed) in the QCD connector 120, thereby indicating the available path of fluid flow through the system. Further, a panel 705 may display alerts and statuses of operations being conducted. It is further envisioned that the HMI 116 may be a touch screen such that the operator (114) may open and close valves directly through the HMI 116. Additionally, the HMI 116 may have buttons or portions of the touch screen 704 corresponding to commands in the simulated hydraulic fracturing system.

Additionally, the HMI 116 may store and display a logging of the operator 114 requesting valve operations and real-time logging of operational metric such as duration between various stages and determining field efficiency. Further, the HMI 116 may have a notification of current stage and alarming when valve moves out of place, such that an automated notification of possible hazards in actuating certain valves may be displayed on the the HMI 116.

Referring back to FIG. 1, it is further envisioned that the plurality of sensors 111 may be used to determine a real-time conditioning of the plurality of devices, such as locking dogs. In a non-limiting example, the software application, in one method, may instruct the plurality of sensors 111 to monitor a hydraulic pressure and stroke signature of the QCD connector 120. The software application may then correlate said readings with a known pattern determined by experimentally and theoretically calculated data on the QCD connector 120 operating under good conditions. Further, the pressure stroke signature may be known to follow a fixed pattern for the QCD connector 120. In an additional approach, the software application may instruct the plurality of sensors 111 to monitor hydraulic pressure spikes and volume of hydraulic fluid to determine a health status of the QCD connector 120. In particular, algorithms based on the QCD connector 120 may be used to determine when the valve is failing due to, for example, poor pressure conditions. It is further envisioned that the plurality of sensors 111 may utilize a combination of vibration and strain sensors to determine load on a valve stem and may correlate said load to an overall health of the QCD connector 120.

Furthermore, a safety measure may be programmed in the software application such that the plurality of sensors 111 may automatically count a number of times the QCD connector 120 is engaged and disengaged. Based on said safety measure, an automatic trigger may actuate such that the operator 114 is alerted once a pre-determined number of the QCD connector 120 actuations (e.g., open/closed) has been reached. In a non-limiting example, the software application, through the plurality of sensors 111, may regulate an air manifold to prevent over-pressure of devices. The software application may use data based on the real-time valve position to prevent overpressure or other costly mistakes during the fracturing operations. It is further envisioned that safety and efficiency at the rig site may be increased by providing automated actuation of the QCD connector 120, remotely and outside of a redzone (e.g., an area approximate the plurality of devices).

According to embodiments of the present disclosure, a general plan suitable for use in planning of hydraulic fracturing operations may be operated by a controller on the HPU 150. In some embodiments, the controller may control the operations and automation of the QCD connector 120. For example, if the QCD connector 120 is not yet installed, a land indication sensor reading false to indicate that the QCD connector 120 is in standby mode. With the QCD connector 120 in in standby mode, the controller will communicate with the QCD connector 120 to ensure that the locking dogs are in a disengaged or open position to prevent stabbing of the QCD connector 120 when the locking dogs are in the closed position. Further, if the locking dogs are not in the disengaged or open position, the controller will send a warning and a request to open the locking dogs before exiting standby mode. In another example, the QCD connector 120 may be stabbed on the wellhead assembly 101 with a wireline loaded into lubricator tool. In such an example, the indication sensor on the wellhead assembly 101 will inform the controller that the QCD connector 120 is true to indicate that engagement of the QCD connector 120 is ready. The controller will then send a request to engage the QCD connector 120 and once approved, the controller informs the HPU 150 to engage the locking dogs of the QCD connector 120. With the QCD connector 120 engaged, the controller may further request pressure test on any seal and may lock the operations if the pressure tests are not performed.

Figure 8A:
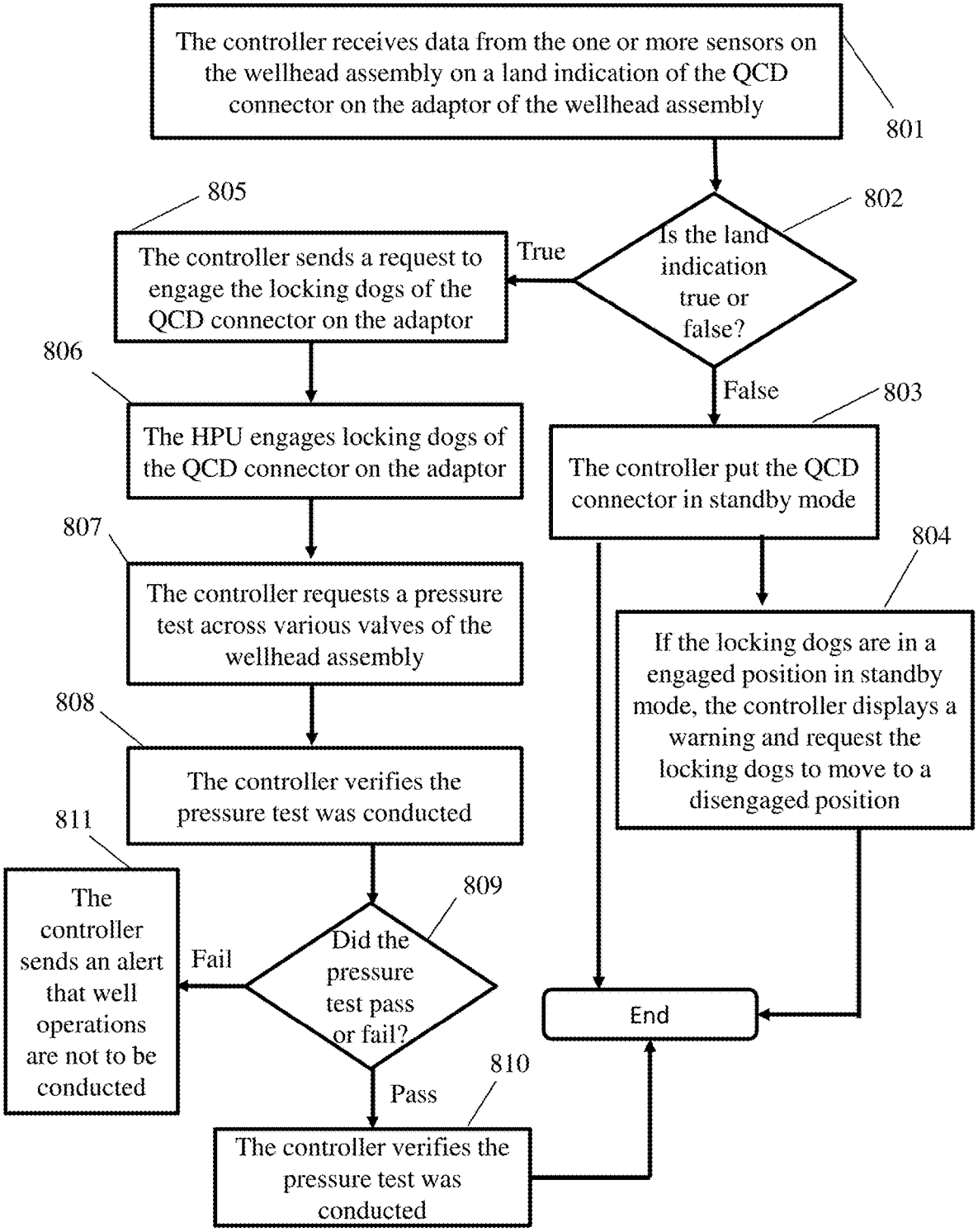
FIG. 8A-8C illustrate flowcharts according to one or more embodiments of the present disclosure.
Figure 8B:
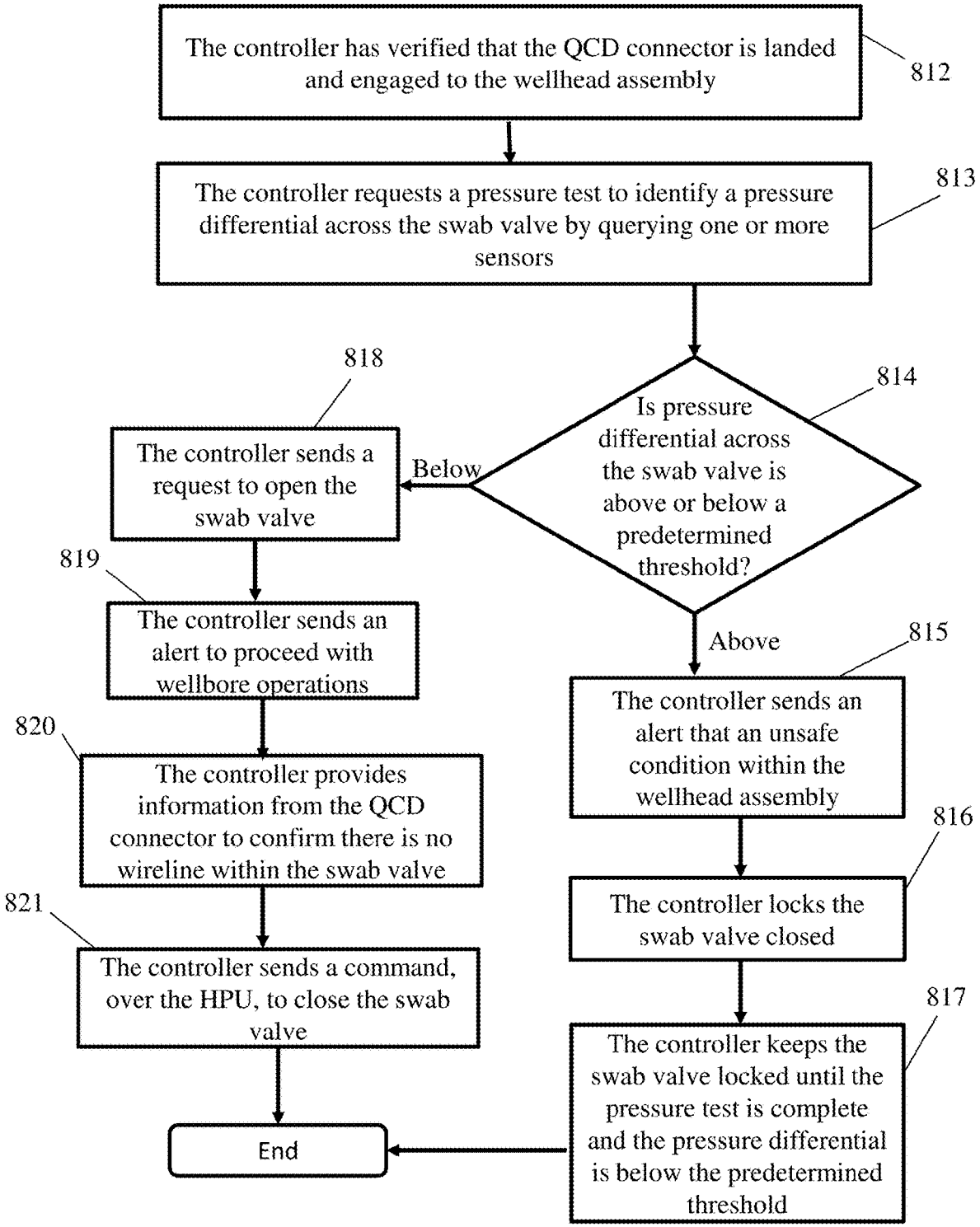
Figure 8C:
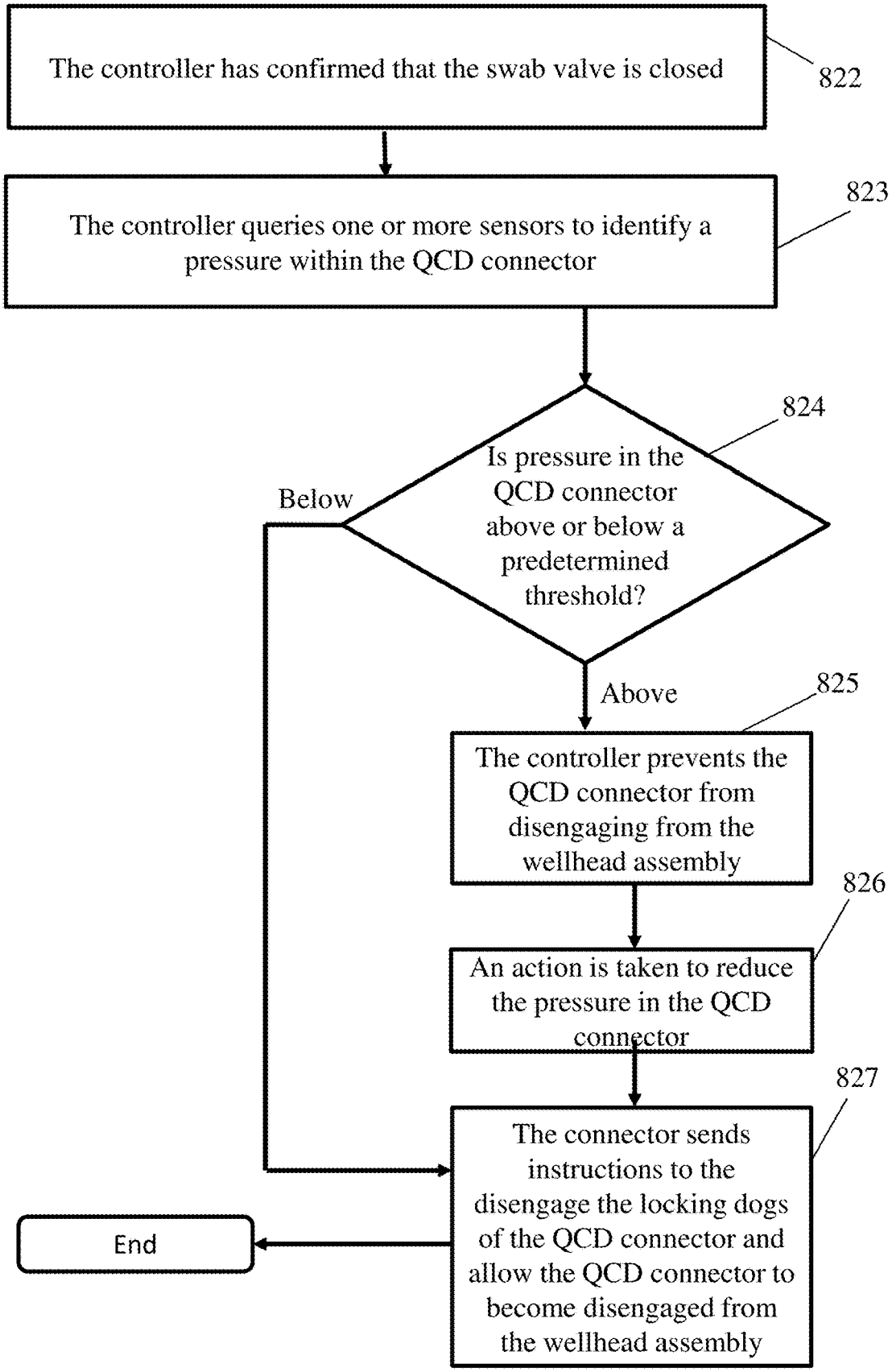

Turning to FIGS. 8A-8C, FIGS. 8A-8C show various example flowcharts in accordance with one or more embodiments. Specifically, FIGS. 8A-8C describe a general method for operating and managing the wellhead assembly 101 and the QCD connector 120 with a controller. One or more blocks in FIGS. 8A-8C may be performed by one or more components (e.g., the controller on the HPU 150) as described in FIGS. 1-7. While the various blocks in FIGS. 8A-8C are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

As shown in FIG. 8A, the controller may prevent the QCD connector 120 from being stabbed on the adaptor 121 while the locking dogs 134 are engaged. Additionally, the controller may prevent engagement of the locking dogs 134 until the QCD connector 120 is landed on the adaptor 121 and set reminders for conducting pressure tests. In Block 801, the controller receives data from the one or more sensors 111 on the wellhead assembly 101 on a land indication of the QCD connector 120 on the adaptor 121. Next, in Block 802, the controller determines if the land indication is true or false based on the received data. If the answer is false, the QCD connector 120 is not landed on the adaptor 121, and the controller puts the QCD connector 120 in standby mode (see Block 803) such that the locking dogs 134 are in a disengaged position. Optionally, in Block 804, if the QCD connector 120 is in standby mode and the locking dogs 134 are in an engaged position, the controller will display a warning on the HMI 116 and request the locking dogs 134 to move to the disengaged position to avoid stabbing while the locking dogs 134 are in an engaged position.

In Block 802, if the answer is true, the QCD connector 120 is landed on the adaptor 121. In Block 805, the controller sends a request to engage the locking dogs 134 of the QCD connector 120 on the adaptor 121. Once the request is approved, the HPU 150 engages the locking dogs 134 on the adaptor 121 (see Block 806). In Block 807, once the locking dogs 134 are engaged, the controller requests a pressure test across various valves (301, 302, 303*a*, 303*b*, 304) of the wellhead assembly 101. In Block 808, the controller verifies the pressure test was conducted based on data received from the one or more sensors 111. Additionally, the controller uses the data from the one or more sensors 111 to determine if the various valves (301, 302, 303*a*, 303*b*, 304) passed or failed the pressure test (see Block 809). If the various valves (301, 302, 303*a*, 303*b*, 304) passed the pressure test, the controller sends an alert that well operations are to be conducted (see Block 810). If the various valves (301, 302, 303*a*, 303*b*, 304) failed the pressure test, the controller sends an alert that well operations are not to be conducted (see Block 811) and a diagnostics may be ran to determine how to repair the various valves (301, 302, 303*a*, 303*b*, 304).

In some embodiments, the controller on the HPU 150 may control the opening and closing of valves in the wellhead assembly 101, and may prevent such actions if predetermined safety conditions are not satisfied. As shown in FIG. 8B, in Block 812, the controller has verified that the QCD connector 120 is landed and engaged to the wellhead assembly 101. The swab valve 304 of the wellhead assembly 101 must be opened before wireline operations within the wellhead assembly 101 and wellbore operations can commence. In Block 813, the controller may request a pressure test to identify a pressure differential across the swab valve 304 by querying the one or more sensors 111. In Block 814, the controller uses data from the one or more sensors 111 to determine if the pressure differential across the swab valve 304 is above or below a predetermined threshold. If the pressure differential across the swab valve 304 is above the predetermined threshold, the controller sends an alert that an unsafe condition within the wellhead assembly (see Block 815) needs to be addresses before the swab valve 304 can be opened. In Block 816, the controller locks the swab valve 304 closed to ensure no operations are performed with the pressure differential above the predetermined threshold. In Block 817, the controller keeps the swab valve locked until the pressure test is complete and the pressure differential is below the predetermined threshold.

In Block 818, the pressure differential is below the predetermined threshold and the controller sends a request to open the swab valve 304. In Block 819, with the swab valve 304 open, the controller sends an alert to proceed with wellbore operations, such as inserting a wireline in the wellhead assembly 101. Similarly, in order to close the swab valve 304 at the conclusion of the wireline operation, the controller may provide information from the QCD connector 120 to ensure there is no wireline within the swab valve 304 (see Block 820). In Block 821, once the controller receives confirmation from the QCD connector 120 that there is no wireline, the controller sends a command, over the HPU, to close the swab valve 304. The controller may prevent the swab valve 304 from closing until that confirmation is received.

It is further envisioned that the controller may determine if the QCD connector 120 may be disengaged from the wellhead assembly 101 after the swab valve has been closed, isolating the QCD connector 120 from pressure within the wellhead assembly. As shown in FIG. 8C, in Block 822 the controller has confirmed that the swab valve 304 is closed. After the controller has confirmed that the swab valve is closed, in Block 823, the controller may query one or more sensors 111 to identify a pressure within the QCD connector 120. In Block 824, the controller determines whether that pressure is below or above a predetermined threshold. If the pressure is above the predetermined threshold, the controller may prevent the QCD connector 120 from disengaging from the wellhead assembly 101 (see Block 825) until an action is taken to reduce the pressure in the QCD connector 120 (see Block 826). In Block 827, once the taken action reduces the pressure within the QCD connector 120 below the predetermined threshold, the connector sends instructions to disengage the locking dogs 314 of the QCD connector 120 and allow the QCD connector 120 to become disengaged from the wellhead assembly 101 and send instructions to the disengage the locking dogs of the QCD connector 120. However, in Block 824, if the pressure is below the predetermined threshold, the controller may skip Blocks 825 and 826 and proceed directly to Block 827.

In one or more embodiments, the software application of an automated QCD connector may automatically generate optimal responses by using artificial intelligence ("AI") and/or machine learning ("ML"). In a non-limiting example, the optimal responses may be due to unforeseen events such as downhole conditions changing, equipment failures, weather conditions, and/or hydraulic fracturing performance changing, where the controller of the HPU 150 may automatically change corresponding to the optimal responses. The optimal responses may optimally and automatically reroute the QCD connector 120 in view of the unforeseen events and potentially unidentified risks. It is further envisioned that the plurality of sensors may continuously feed the software application data, such that addition optimal responses may be suggested on the HMI for the operator to accept or reject. In some embodiments, the operator may manually input, through the HMI, modification to the controller of the HPU 150. One skilled in the art will appreciate how the software application, using AI and/or ML, may learn the manual input from the operator such that predications of potential interruptions may be displayed on the HMI and corresponding optimal responses.

In addition to the benefits described above, the QCD connector may improve an overall efficiency and performance at the rig site while reducing cost. Further, the QCD connector may provide further advantages such as a complete closed loop valve control system, valve transitions may be recorded without visual inspection, partial valve transitions may be avoided, valve transition times may be optimized given the closed loop feedback, an automated valve rig up/checkout procedure may ensure that the flow lines have been attached to the intended actuators, and may reduce or eliminate human interaction with the rig equipment to reduce communication/confusion as a source of incorrect valve state changes. Additionally, the QCD connector may provide accountability and methods to prevent cutting of wireline by sending notifications on a HMI and verification by wireline operator. Further, the QCD connector may prevent swab valves, lower master valves and upper master valves from being opened under high differential pressures. As a result, the QCD connector may prevent damage from occurring to equipment and avoid non-productive time. It is noted that the QCD connector may be used for onshore and offshore oil and gas operations.

Figure 9A:
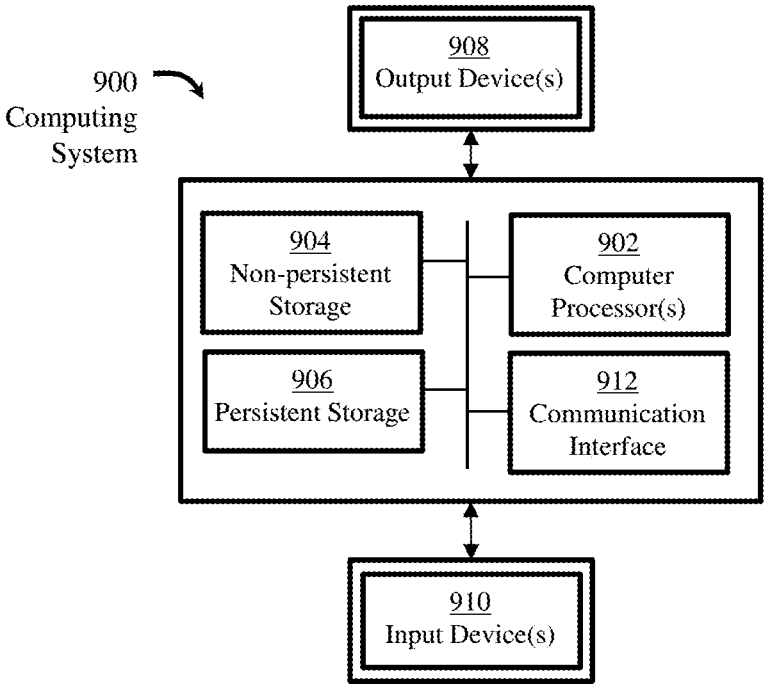
FIGS. 9A and 9B show a computing system in accordance with one or more embodiments.

Embodiments may be implemented on a computing system coupled to the controller. Any combination of mobile, desktop, server, router, switch, embedded device, or other types of hardware may be used. For example, as shown in FIG. 9A, the computing system 900 may include one or more computer processors 902, non-persistent storage 904

(e.g., volatile memory, such as random access memory (RAM), cache memory), persistent storage 906 (e.g., a hard disk, an optical drive such as a compact disk (CD) drive or digital versatile disk (DVD) drive, a flash memory, etc.), a communication interface 912 (e.g., Bluetooth interface, infrared interface, network interface, optical interface, etc.), and numerous other elements and functionalities.

The computer processor(s) 902 may be an integrated circuit for processing instructions. For example, the computer processor(s) may be one or more cores or micro-cores of a processor. The computing system 900 may also include one or more input devices 910, such as a touchscreen, keyboard, mouse, microphone, touchpad, electronic pen, or any other type of input device.

The communication interface 912 may include an integrated circuit for connecting the computing system 900 to a network (not shown) (e.g., a local area network (LAN), a wide area network (WAN) such as the Internet, mobile network, or any other type of network) and/or to another device, such as another computing device.

Further, the computing system 900 may include one or more output devices 808, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) 902, non-persistent storage 904, and persistent storage 906. Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the disclosure.

Figure 9B:
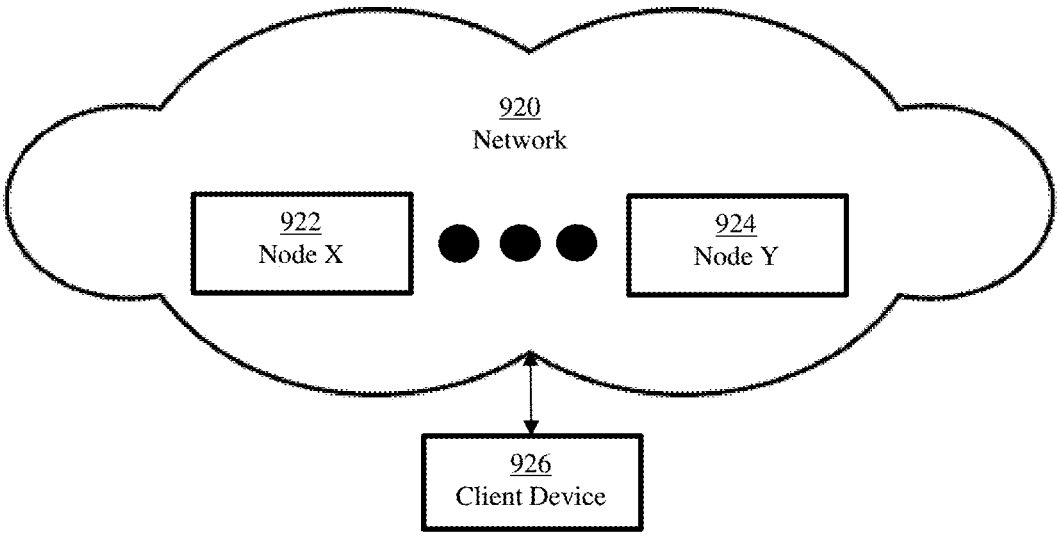

The computing system 900 in FIG. 9A may be connected to or be a part of a network. For example, as shown in FIG. 9B, the network 920 may include multiple nodes (e.g., node X 922, node Y 924). Each node may correspond to a computing system, such as the computing system shown in FIG. 9A, or a group of nodes combined may correspond to the computing system shown in FIG. 9A. By way of an example, embodiments of the disclosure may be implemented on a node of a distributed system that is connected to other nodes. By way of another example, embodiments of the disclosure may be implemented on a distributed computing system having multiple nodes, where each portion of the disclosure may be located on a different node within the distributed computing system. Further, one or more elements of the aforementioned computing system 900 may be located at a remote location and connected to the other elements over a network.

Although not shown in FIG. 8B, the node may correspond to a blade in a server chassis that is connected to other nodes via a backplane. By way of another example, the node may correspond to a server in a data center. By way of another example, the node may correspond to a computer processor or micro-core of a computer processor with shared memory and/or resources.

The nodes (e.g., node X 922, node Y 924) in the network 920 may be configured to provide services for a client device 926. For example, the nodes may be part of a cloud computing system. The nodes may include functionality to receive requests from the client device 926 and transmit responses to the client device 926. The client device 926 may be a computing system, such as the computing system shown in FIG. 9A. Further, the client device 926 may include and/or perform all or a portion of one or more embodiments of the disclosure.

The computing system or group of computing systems described in FIGS. 8A and 8B may include functionality to perform a variety of operations disclosed herein. For example, the computing system(s) may perform communication between processes on the same or different systems. A variety of mechanisms, employing some form of active or passive communication, may facilitate the exchange of data between processes on the same device. Examples representative of these inter-process communications include, but are not limited to, the implementation of a file, a signal, a socket, a message queue, a pipeline, a semaphore, shared memory, message passing, and a memory-mapped file. Further details pertaining to a couple of these non-limiting examples are provided below.

Based on the client-server networking model, sockets may serve as interfaces or communication channel endpoints enabling bidirectional data transfer between processes on the same device. Foremost, following the client-server networking model, a server process (e.g., a process that provides data) may create a first socket object. Next, the server process binds the first socket object, thereby associating the first socket object with a unique name and/or address. After creating and binding the first socket object, the server process then waits and listens for incoming connection requests from one or more client processes (e.g., processes that seek data). At this point, when a client process wishes to obtain data from a server process, the client process starts by creating a second socket object. The client process then proceeds to generate a connection request that includes at least the second socket object and the unique name and/or address associated with the first socket object. The client process then transmits the connection request to the server process. Depending on availability, the server process may accept the connection request, establishing a communication channel with the client process, or the server process, busy in handling other operations, may queue the connection request in a buffer until the server process is ready. An established connection informs the client process that communications may commence. In response, the client process may generate a data request specifying the data that the client process wishes to obtain. The data request is subsequently transmitted to the server process. Upon receiving the data request, the server process analyzes the request and gathers the requested data. Finally, the server process then generates a reply including at least the requested data and transmits the reply to the client process. The data may be transferred, more commonly, as datagrams or a stream of characters (e.g., bytes).

Shared memory refers to the allocation of virtual memory space in order to substantiate a mechanism for which data may be communicated and/or accessed by multiple processes. In implementing shared memory, an initializing process first creates a shareable segment in persistent or non-persistent storage. Post creation, the initializing process then mounts the shareable segment, subsequently mapping the shareable segment into the address space associated with the initializing process. Following the mounting, the initializing process proceeds to identify and grant access permission to one or more authorized processes that may also write and read data to and from the shareable segment. Changes made to the data in the shareable segment by one process may immediately affect other processes, which are also linked to the shareable segment. Further, when one of the authorized processes accesses the shareable segment, the shareable segment maps to the address space of that authorized process. Often, one authorized process may mount the shareable segment, other than the initializing process, at any given time.

Other techniques may be used to share data, such as the various data described in the present application, between processes without departing from the scope of the disclosure. The processes may be part of the same or different application and may execute on the same or different computing system.

Rather than or in addition to sharing data between processes, the computing system performing one or more embodiments of the disclosure may include functionality to receive data from a user. For example, in one or more embodiments, a user may submit data via a graphical user interface (GUI) on the user device. Data may be submitted via the graphical user interface by a user selecting one or more graphical user interface widgets or inserting text and other data into graphical user interface widgets using a touchpad, a keyboard, a mouse, or any other input device. In response to selecting a particular item, information regarding the particular item may be obtained from persistent or non-persistent storage by the computer processor. Upon selection of the item by the user, the contents of the obtained data regarding the particular item may be displayed on the user device in response to the user's selection.

By way of another example, a request to obtain data regarding the particular item may be sent to a server operatively connected to the user device through a network. For example, the user may select a uniform resource locator (URL) link within a web client of the user device, thereby initiating a Hypertext Transfer Protocol (HTTP) or other protocol request being sent to the network host associated with the URL. In response to the request, the server may extract the data regarding the particular selected item and send the data to the device that initiated the request. Once the user device has received the data regarding the particular item, the contents of the received data regarding the particular item may be displayed on the user device in response to the user's selection. Further to the above example, the data received from the server after selecting the URL link may provide a web page in Hyper Text Markup Language (HTML) that may be rendered by the web client and displayed on the user device.

Once data is obtained, such as by using techniques described above or from storage, the computing system, in performing one or more embodiments of the disclosure, may extract one or more data items from the obtained data. For example, the extraction may be performed as follows by the computing system 800 in FIG. 8A. First, the organizing pattern (e.g., grammar, schema, layout) of the data is determined, which may be based on one or more of the following: position (e.g., bit or column position, Nth token in a data stream, etc.), attribute (where the attribute is associated with one or more values), or a hierarchical/tree structure (consisting of layers of nodes at different levels of detail—such as in nested packet headers or nested document sections). Then, the raw, unprocessed stream of data symbols is parsed, in the context of the organizing pattern, into a stream (or layered structure) of tokens (where each token may have an associated token "type").

Next, extraction criteria are used to extract one or more data items from the token stream or structure, where the extraction criteria are processed according to the organizing pattern to extract one or more tokens (or nodes from a layered structure). For position-based data, the token(s) at the position(s) identified by the extraction criteria are extracted. For attribute/value-based data, the token(s) and/or node(s) associated with the attribute(s) satisfying the extraction criteria are extracted. For hierarchical/layered data, the token(s) associated with the node(s) matching the extraction criteria are extracted. The extraction criteria may be as simple as an identifier string or may be a query presented to a structured data repository (where the data repository may be organized according to a database schema or data format, such as XML).

The extracted data may be used for further processing by the computing system. For example, the computing system of FIG. 8A, while performing one or more embodiments of the disclosure, may perform data comparison. Data comparison may be used to compare two or more data values (e.g., A, B). For example, one or more embodiments may determine whether A>B, A=B, A !=B, A<B, etc. The comparison may be performed by submitting A, B, and an opcode specifying an operation related to the comparison into an arithmetic logic unit (ALU) (i.e., circuitry that performs arithmetic and/or bitwise logical operations on the two data values). The ALU outputs the numerical result of the operation and/or one or more status flags related to the numerical result. For example, the status flags may indicate whether the numerical result is a positive number, a negative number, zero, etc. By selecting the proper opcode and then reading the numerical results and/or status flags, the comparison may be executed. For example, in order to determine if A>B, B may be subtracted from A (i.e., A−B), and the status flags may be read to determine if the result is positive (i.e., if A>B, then A−B>0). In one or more embodiments, B may be considered a threshold, and A is deemed to satisfy the threshold if A=B or if A>B, as determined using the ALU. In one or more embodiments of the disclosure, A and B may be vectors, and comparing A with B includes comparing the first element of vector A with the first element of vector B, the second element of vector A with the second element of vector B, etc. In one or more embodiments, if A and B are strings, the binary values of the strings may be compared.

The computing system in FIG. 9A may implement and/or be connected to a data repository. For example, one type of data repository is a database. A database is a collection of information configured for ease of data retrieval, modification, re-organization, and deletion. Database Management System (DBMS) is a software application that provides an interface for users to define, create, query, update, or administer databases.

The user, or software application, may submit a statement or query into the DBMS. Then the DBMS interprets the statement. The statement may be a select statement to request information, update statement, create statement, delete statement, etc. Moreover, the statement may include parameters that specify data, or data container (database, table, record, column, view, etc.), identifier(s), conditions (comparison operators), functions (e.g. join, full join, count, average, etc.), sort (e.g. ascending, descending), or others. The DBMS may execute the statement. For example, the DBMS may access a memory buffer, a reference or index a file for read, write, deletion, or any combination thereof, for responding to the statement. The DBMS may load the data from persistent or non-persistent storage and perform computations to respond to the query. The DBMS may return the result(s) to the user or software application.

The computing system of FIG. 9A may include functionality to present raw and/or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model.

For example, a GUI may first obtain a notification from a software application requesting that a particular data object be presented within the GUI. Next, the GUI may determine a data object type associated with the particular data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the particular data object and render a visual representation of the data values within a display device according to the designated rules for that data object type.

Data may also be presented through various audio methods. In particular, data may be rendered into an audio format and presented as sound through one or more speakers operably connected to a computing device.

Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

The above description of functions presents only a few examples of functions performed by the computing system of FIG. 9A and the nodes and/or client device in FIG. 9B. Other functions may be performed using one or more embodiments of the disclosure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed as new and desired to be protected by Letters Patent of the United States is:

1. A method, comprising:

placing a controller in communication with a connector disposed on a wellhead assembly, wherein a hydraulic power unit is coupled to a top of the connector and the controller, wherein the connector comprises a first portion and a second portion separated by a middle ring, and a stab body extending outwardly from the second portion and into the first portion, wherein a bore of the stab body is coaxial with a bore of the wellhead assembly;

receiving at the controller one or more conditions associated with the connector and a valve of the wellhead assembly; and operating via the controller at least one of the connector and the valve based on the one or more conditions.

2. The method of claim 1, wherein the step of receiving at the controller one or more conditions associated with the connector and the valve comprises verifying a seal pressure test of the connector was successful or not via the controller, and wherein the step of operating via the controller at least one of the connector and the valve based on the one or more conditions comprises sending a command to open the valve if the seal pressure test is successful.

3. The method of claim 1, further comprising receiving at the controller an indication if a wireline is within the valve via one or more sensors on the wellhead assembly, and if there is no wireline, the controller sends a command to close the valve.

4. The method of claim 1, wherein the step of receiving at the controller one or more conditions associated with the connector verifies if the connector is landed on the wellhead assembly.

5. The method of claim 4, further comprising sending requests, via the controller, to engage or disengage locking dogs of the connector based on the one or more conditions associated with the connector.

6. The method of claim 1, further comprising sending permission requests, via the controller, to a human operator to perform a sequence of valve operations.

7. The method of claim 6, further comprising confirming the sent permission requests and performing the sequence of valve operations with the hydraulic power unit.

8. The method of claim 7, further comprising sending via the controller alerts to the hydraulic power unit based on the one or more conditions.

9. A non-transitory computer-readable medium comprising instructions, executable by a processor, the instructions comprising:

functionality to control a connector coupled to a wellhead assembly, wherein a hydraulic power unit is coupled to a top of the connector, wherein the connector comprises a first portion and a second portion separated by a middle ring, and a stab body extending outwardly from the second portion and into the first portion, wherein a bore of the stab body is coaxial with a bore of the wellhead assembly, the functionality comprising:

displaying components and commands of the connector on a touch screen in communication with the hydraulic power unit;

collecting data on a state and position of valves in the wellhead assembly and the connector;

sending commands to unlock, lock, or vent the connector based on the collected data;

opening or closing valves of the wellhead assembly based on the collected data.

10. The non-transitory computer-readable medium of claim 9, the instructions further comprising functionality for displaying, on the touch screen, alerts and statuses of operations being conducted on the connector and the wellhead assembly.

11. The non-transitory computer-readable medium of claim 9, further comprising sending an alarm when the valves move out of position.

12. The non-transitory computer-readable medium of claim 9, further comprising, based on the collected data, displaying a condition of the valves.

13. The non-transitory computer-readable medium of claim 12, further comprising monitoring a hydraulic pressure and a stroke signature of the connector to determine the condition of the valves.

14. The non-transitory computer-readable medium of claim 9, further comprising actuating locking dogs of the connector to engage or disengage on the wellhead assembly.

15. The non-transitory computer-readable medium of claim 14, further comprising indicating when the connector landed on the wellhead assembly to engage the locking dogs.

16. The non-transitory computer-readable medium of claim 9, further comprising executing a sequence of valve operations.

17. A system, comprising:

a connector coupled to a wellhead assembly, wherein the connector comprises:

a first portion and a second portion separated by a middle ring; and a stab body extending outwardly from the second portion and into the first portion, wherein a bore of the stab body is coaxial with a bore of the wellhead assembly;

a hydraulic power unit coupled to a top of the connector and a valve of the wellhead assembly; and a controller in communication with the connector and the hydraulic power unit, wherein controller is operable to receive one or more conditions associated with the connector and the valve; and operate at least one of the connector and the valve through the hydraulic power unit based on the one or more condition.

18. The system of claim 17, further comprising a plurality of sensors disposed on and/or within connector, the wellhead assembly, and the hydraulic power unit, and wherein the plurality of sensors are in communication with the controller.

19. The system of claim 17, wherein a pin end of the stab body is inserted or stabbed into a female connection of an adaptor on top of the wellhead assembly.

20. The system of claim 19, wherein locking dogs of the connector engage an outer surface of the stab body and the adaptor to lock the adaptor and the connector together.

* * * * *